US008062194B2

(12) United States Patent
Weiss

(10) Patent No.: US 8,062,194 B2
(45) Date of Patent: Nov. 22, 2011

(54) ERGONOMIC WEIGHTED SASH

(75) Inventor: Aviva Weiss, Merion Station, PA (US)

(73) Assignee: Fun and Function, LLC, Merion Station, PA (US)

( * ) Notice: Subject to any disclaimer, the term of this patent is extended or adjusted under 35 U.S.C. 154(b) by 169 days.

(21) Appl. No.: 12/463,684

(22) Filed: May 11, 2009

(65) Prior Publication Data

US 2009/0280966 A1 Nov. 12, 2009

Related U.S. Application Data

(60) Provisional application No. 61/051,944, filed on May 9, 2008.

(51) Int. Cl.
*A63B 21/065* (2006.01)
*A45C 15/00* (2006.01)
*A45F 3/14* (2006.01)

(52) U.S. Cl. ..... 482/105; 482/92; 224/576; 224/257; 224/625; 224/223

(58) Field of Classification Search ..... 482/92, 482/93, 105; 2/69, 94, 95, 102, 279; 450/1, 450/89; D2/728, 731, 829; 224/576, 257, 224/625, 223

See application file for complete search history.

(56) References Cited

U.S. PATENT DOCUMENTS

| | | | | |
|---|---|---|---|---|
| 4,268,917 | A * | 5/1981 | Massey | 2/102 |
| 4,394,012 | A | 7/1983 | Egbert et al. | |
| 4,602,387 | A | 7/1986 | Zakrzewski | |
| 4,658,442 | A | 4/1987 | Tomlinson et al. | |
| 4,989,267 | A * | 2/1991 | Watson | 2/102 |
| 5,002,270 | A | 3/1991 | Shine | |
| D390,338 | S * | 2/1998 | Plasco | D21/683 |
| D409,697 | S | 5/1999 | Ott | |
| 6,081,924 | A | 7/2000 | Ott | |
| 6,200,243 | B1 * | 3/2001 | Meranto | 482/105 |
| 6,209,135 | B1 | 4/2001 | Irvin | |
| 6,286,146 | B1 * | 9/2001 | Rocker | 2/94 |
| 6,557,176 | B2 | 5/2003 | Franco-Sion | |
| 6,669,608 | B1 | 12/2003 | Winston | |
| 6,675,391 | B2 * | 1/2004 | Morrison | 2/102 |
| 6,834,396 | B2 | 12/2004 | Franco-Sion | |
| 7,490,361 | B1 * | 2/2009 | Floyd | 2/94 |
| 7,708,673 | B2 * | 5/2010 | Gibson-Horn | 482/105 |
| 2006/0090240 | A1 | 5/2006 | McKenzie et al. | |
| 2009/0236378 | A1 * | 9/2009 | Crye | 224/148.2 |

FOREIGN PATENT DOCUMENTS

| | | |
|---|---|---|
| CA | 2059520 | 7/1993 |
| WO | WO2007/128456 A1 | 11/2007 |

* cited by examiner

*Primary Examiner* — Stephen Crow
*Assistant Examiner* — Sandhara Ganesan
(74) *Attorney, Agent, or Firm* — Blank Rome LLP

(57) ABSTRACT

The present invention is directed to an ergonomic exercise sash which is contoured to fit a torso of a user. Weight members may be placed in a plurality of pockets of the sash to increase the resistance and intensity of exercise.

17 Claims, 4 Drawing Sheets

ERGONOMIC WEIGHTED SASH

RELATED INVENTION

This application claims benefit of U.S. Application Ser. No. 61/051,944, filed May 9, 2008, entitled "The Ergomonic Weighted Sash," which is incorporated herein by reference.

FIELD OF THE INVENTION

This invention relates generally to an ergonomic exercise vest contoured to fit a torso of a user, which can be used to accommodate weight members of various shapes and weight amounts.

BACKGROUND OF THE INVENTION

Weighted vests are often used in strength, endurance, and muscle building exercises for increasing resistance and intensifying the workout. To enable a person to exercise solely, free the hands, and to carry the load more efficiently, weights have been attached to vests worn over the torso. Weighted vests are designed to burn calories at a quicker rate and increase muscle strength and mass during exercises that are typically known to only increase endurance.

Many vests exists which are based on the concept of carrying weight while having the hands and arms of a user to be unencumbered.

U.S. Pat. No. 6,669,608 B1 granted to Edith Winston entitled "Adjustable Weighted Vest" discloses an exercise vest which includes a plurality of weight receiving vest pockets disposed on the outer surface of the vest.

U.S. Pat. No. 6,209,135 B1 granted to Scott Irvin entitled "Exercise Vest with Flexible Weights" discloses a weighted exercise vest which is comprised of left and right front panels connected to a back panel by elastic sides and webbing straps.

U.S. Pat. No. 6,081,924 B1 granted to Patrick M. Ott entitled "Weighted Training Vest" discloses weighted vest capable of comfortably conforming to the body of a wearer utilizing stretchable shoulder harnesses or straps for full range of motion by the user.

U.S. Pat. No. 5,002,270 granted to Anthony G. Shine entitled "Exercise Vest" discloses an exercise vest which comprises a body having a front, back and two sides all connected at the sides and the front to define an internal cavity and a plurality of pockets for weight placement.

U.S. Pat. No. 4,658,442 granted to Dick Tomlinson et al. entitled "Weight Vest" discloses a snugly-fitting, variable-weight vest for wearing while exercising.

U.S. Pat. No. 4,602,387 granted to Jacek M. Zakrzewski entitled "Weight Vest" discloses weight vest which is fully foam lined, sewn canvas that incorporates means for wearing an adjustable amount of weight.

U.S. Pat. No. 4,394,012 granted to Jeffrey T. Egbert et al. entitled "Weighted Exercise Vest" discloses an exercise vest that selectively allows weight capsules to be inserted into pockets that are wrapped around the chest, back and shoulders.

U.S. Pat. No. 4,268,917 granted to Emmett B. Massey entitled "Variably Weighted Vest" discloses a variably weighted vest for use in exercising comprising a plurality of pockets for holding various weighted materials.

It is desired to provide an ergonomic weighted garment which is designed so as to eliminate injury based on the location of the weights and has a secured and contoured fit.

BRIEF SUMMARY OF THE INVENTION

The invention is directed to an ergonomic exercise sash having an upper portion with a contour of a human shoulder, having a front section continuous with a back section and a lower portion with a contour of a side of a human abdomen, having a front section continuous with a back section. Separating the front section of the upper portion and the front section of the lower section is a first central portion having an upper portion end and a lower portion end extending from the upper portion to the lower portion. The first central portion has width which increases from the upper portion end to the lower portion end, wherein the upper portion end is continuous with the upper portion and the lower portion end is continuous with the lower portion. Separating the back section of the upper portion and the back section of the lower portion is a second central portion having an upper portion end and a lower portion end extending from the upper portion to the lower portion. The first central portion has width which increases from the upper portion end to the lower portion end, wherein the upper portion end is continuous with the upper portion and the lower portion end is continuous with the lower portion. The front section and the back section of the first central portion and the second central portion have a plurality of pockets extending from the upper portion end to the lower portion end.

DETAILED DESCRIPTION OF THE INVENTION

Certain terminology is used herein for convenience only and is not to be taken as a limitation on the present invention. The terminology includes the words specifically mentioned, derivatives thereof and words of similar import. The embodiments discussed herein are not intended to be exhaustive or to limit the invention to the precise form disclosed. These embodiments are chosen and described to best explain the principle of the invention and its application and practical use and to enable others skilled in the art to best utilize the invention.

Figure 1:
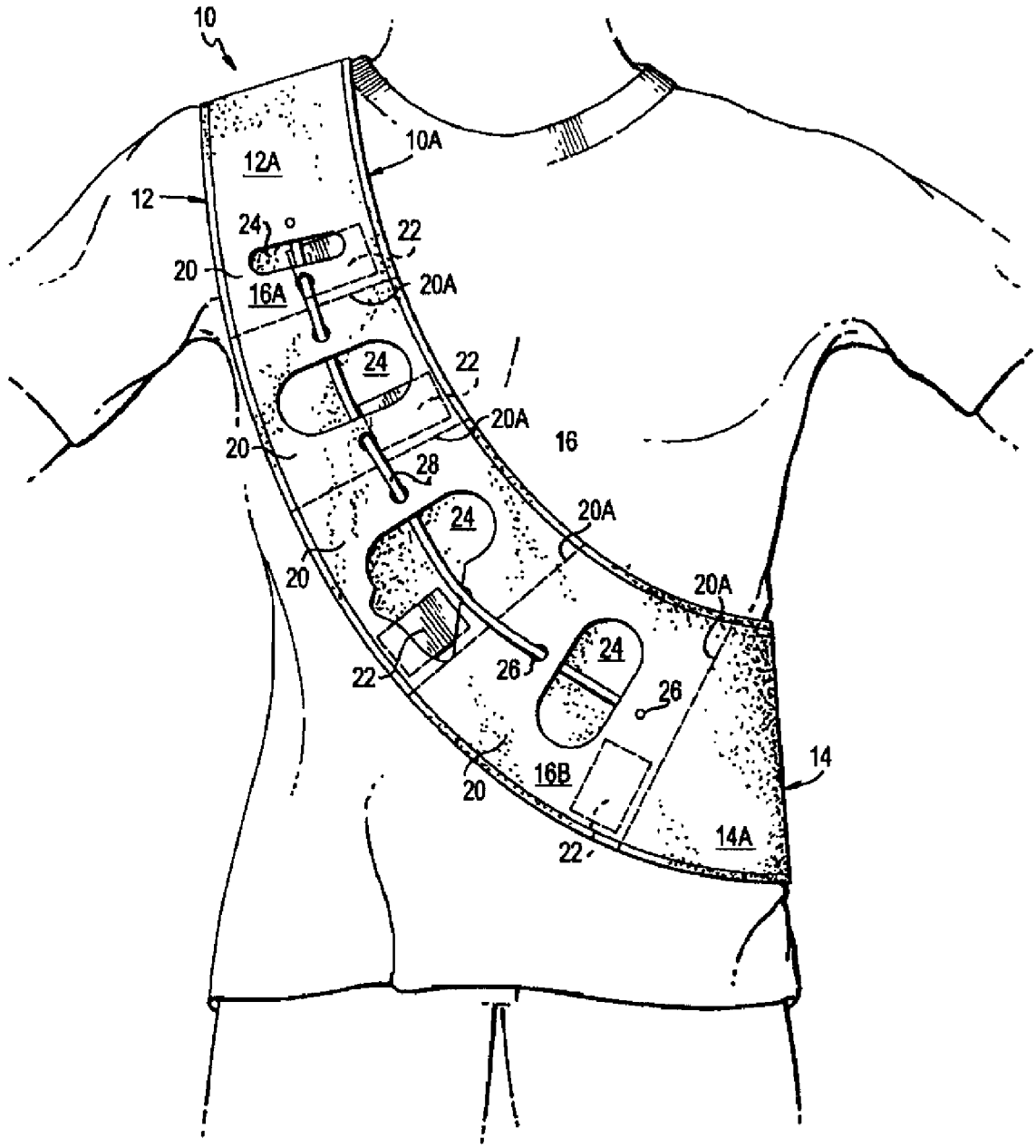
FIG. 1 is a front view of one embodiment of the sash of the present invention illustrated on a user.
Figure 2:
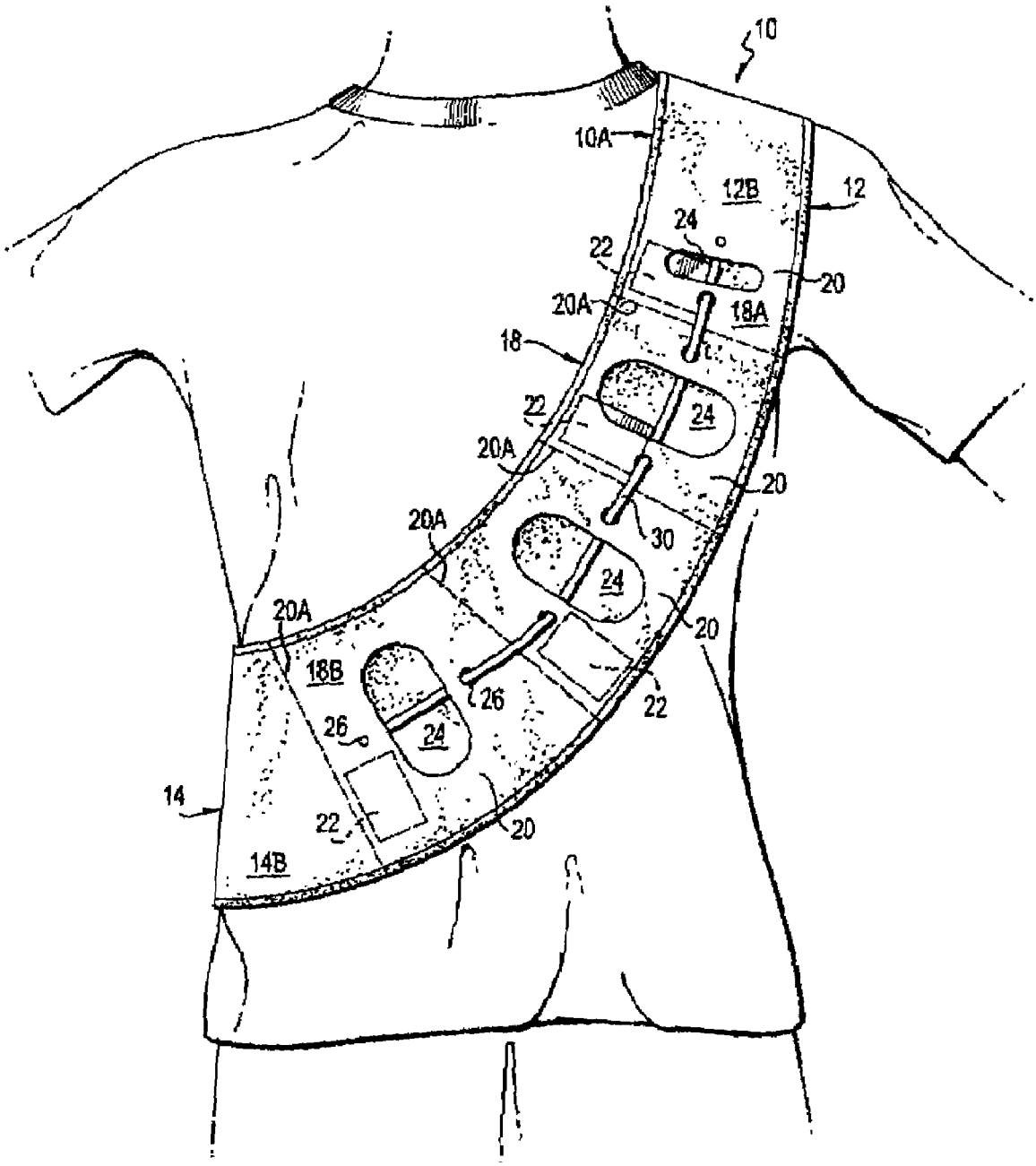
FIG. 2 is a back view of the embodiment of the sash of the present invention illustrated on a user of FIG. 1.

Referring to FIGS. 1 and 2, the invention as shown in this particular embodiment is an ergonomic exercise sash 10 having an upper portion with a contour of a human shoulder 12, having a front section 12A continuous with a back section 12B, and a lower portion with a contour of a side of a human abdomen 14, having a front section 14A continuous with a back section 14B. Separating the front section of the upper portion 12A and the front section of the lower section 14A is a first central portion 16 having an upper portion end 16A and a lower portion end 16B extending from the upper portion 12 to the lower portion 14. The first central portion 16 has width which increases from the upper portion end 16A to the lower portion end 16B, wherein the upper portion end 16A is continuous with the upper portion 12 and the lower portion end 16B is continuous with the lower portion 14. Separating the back section 12B of the upper portion 12 and the back section 14B of the lower portion 14 is a second central portion 18 having an upper portion end 18A and a lower portion end 18B extending from the upper portion 12 to the lower portion 14.

The second central portion 18 has width which increases from the upper portion end 18A to the lower portion end 18B, wherein the upper portion end 18A is continuous with the upper portion 12 and the lower portion end 18B is continuous with the lower portion 14.

The first central portion 16 and the second central portion 18 have a plurality of pockets 20 extending from the upper portion end 16A, 18A to the lower portion end 16B, 18B. The pockets 20 increase in size from the upper portion end 16A, 18A to the lower portion end 16B, 18B of the first central portion 16 and the second central portion 18.

A plurality of weight members 22 (illustrated in phantom) are configured in size to the pockets 20. The plurality of pockets 20 each has a bottom section 20A (illustrated in phantom) which traverse the first central portion 16 and the second central portion 18 to distribute the weight members 22 to an internal side of the sash 10A, wherein the weight members 22 are centralized on a torso of a user. The pockets 20 have an access opening 24 to place and remove the weight members 22 as desired. The weight members will be of various weight measurement but will be of the same size so as to fit within the pockets 20. Further, the shape of the weights will be uniform to ensure the weight distribution is parallel with the other weight members 22 being used.

A pair of inlets 26 are positioned about the midline of the access openings 24 of the pockets 20. A first tension cord 28 extends continuously through each pair of inlets 26 on the first central portion 16 and a second tension cord 30 extends continuously through each pair of inlets 26 in the second central portion 18. The first and second tension cords 28, 30 accomplish two tasks, 1) maintain the weight member in the proper position so as to align each weight 22 member so the load from the weight member 22 is distributed in a parallel configuration on the torso of a user, and 2) it secures the first central portion 16 and the second central portion 18 in a snug fit to the torso of a user. This function of the first tension cord 28 and the second tension cord 30 in combination with upper portion with a contour of a human shoulder 12, and a lower portion with a contour of a side of a human abdomen 14, ensure a snug fit while exercising but prevents "crawling" of the sash 10 due to the weight load distribution of the weight members 22. Appreciating this concept, the sash is symmetrical about a midline in the lower portion 14.

The sash can be made of a anti-microbial, anti-bacterial material or a standard lightweight material or combination thereof. Additionally, the sash will include reflective material.

Figure 3:
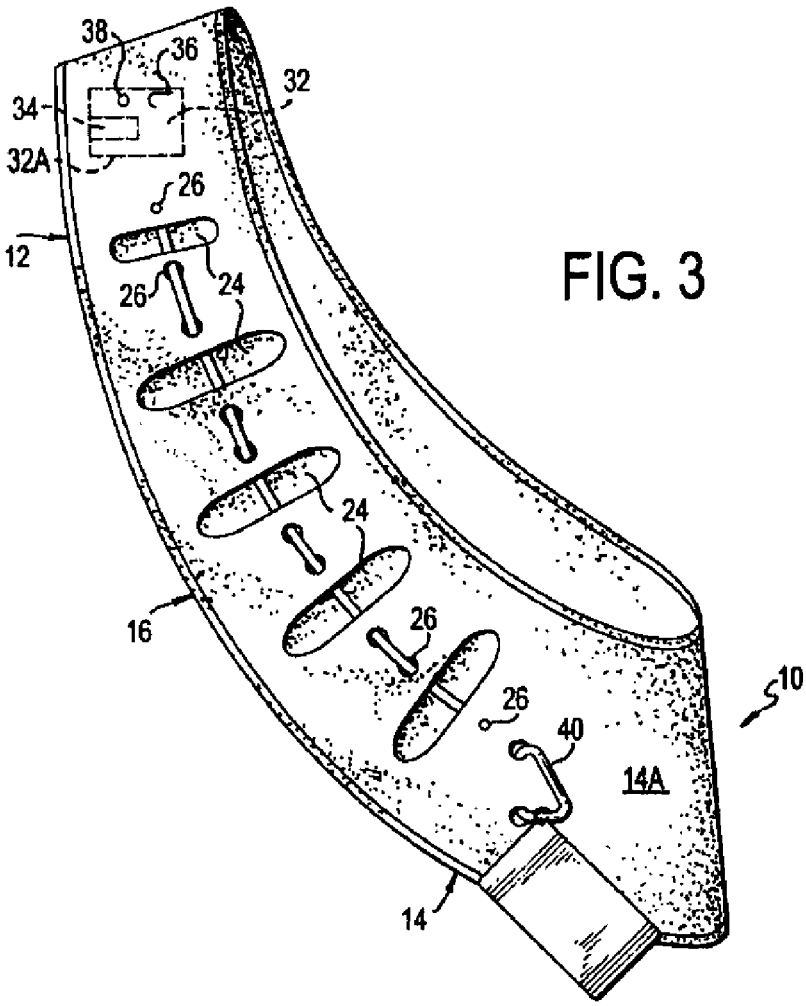
FIG. 3 is a front view of the sash of the present invention illustrating additional accessories.

Referring to FIG. 3, the sash is illustrated with additional features such as a portable media player pocket 32 proximate on the upper portion 12, wherein the portable media pocket 32 includes a portable media player securing device 34, such as an elastic band sewn into the portable media player pocket 32. A cord wrap device 36 can be a simple j-shaped extension sewn into the portable media player pocket 32. Finally, an eyelet 38 configured for a spacer (not shown) on a headphone set for a portable media player (not shown), maintains the spacer and cord of the headphone set with the portable media player pocket 32. The weight of this feature would be negligible and therefore would not effect the central concepts of weight distribution discussed herein. However, the portable media player pocket will have a bottom section 32A which will traverse the upper portion 12 to distribute the weight of a portable media player to an internal side of the sash, centralized on a torso of a user.

Another feature is a grommet 40 centralized on the first central portion of the sash. This will allow the attachment of a small purse or carrying case for items such as keys or coins.

Figure 4:
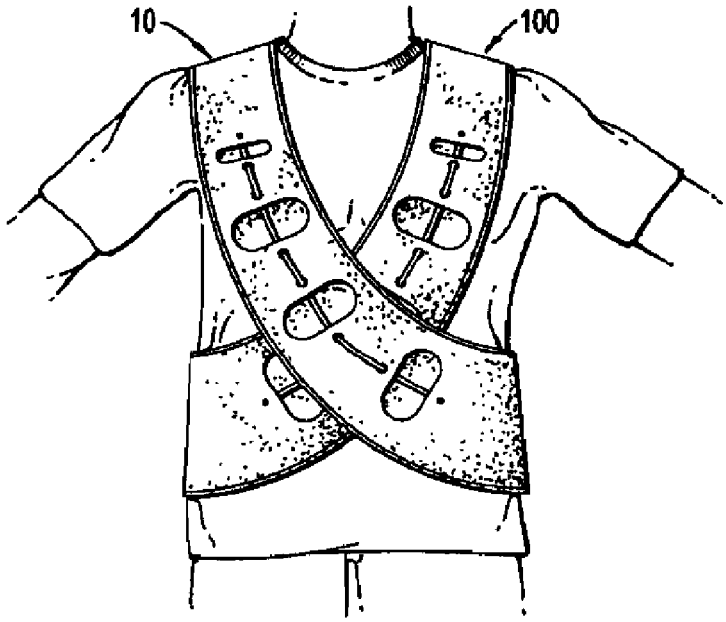
FIG. 4 is front view of a first sash of the present invention worn in combination with a second sash of the invention.

It is contemplated the sash 10 could be worn in combination with a second sash 10 of the invention as illustrated in FIG. 4. It is not necessary but it may be desired to have a fastener, such as a hook, centrally positioned in the first central portion and the second central portion for attachment of the second sash.

The sash could be constructed in a continuous one-piece design or the sash is one piece having a fastener attached a first opened end on upper portion to a second opened end on the upper portion. One of skill in the art would recognize it would be possible to have a multi-piece sash and stay within the spirit of the invention.

Figure 5:
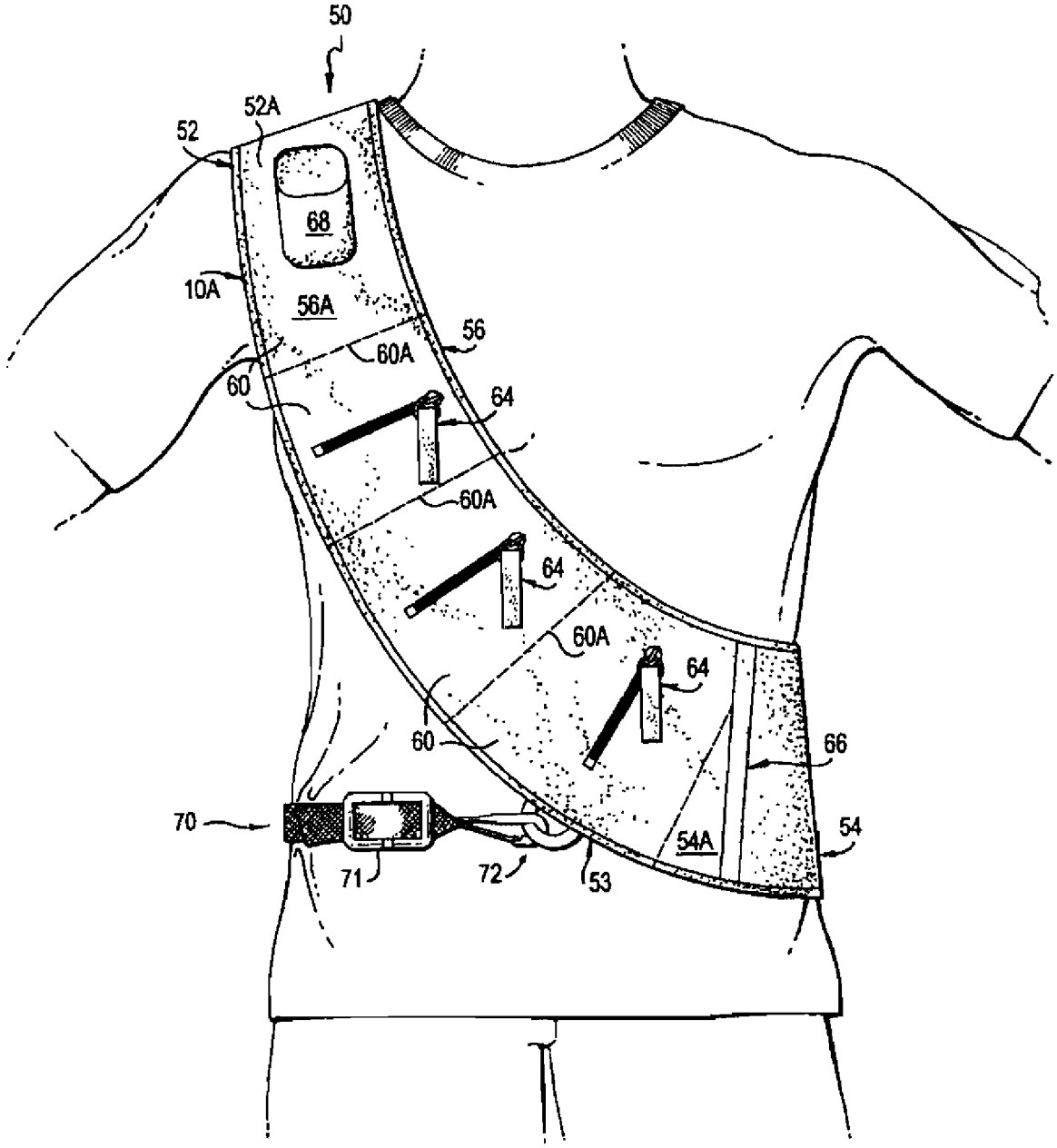
FIG. 5 is a front view of an alternative embodiment of the sash of the present invention.

FIG. 5 illustrates the front view of an alternative embodiment of the ergonomic exercise sash 50 of the present invention. This particular embodiment comprises an upper portion with a contour of a human shoulder 52, having a front section 52A continuous with a back section (not shown), and a lower portion with a contour of a side of a human abdomen 54, having a front section 54A continuous with a back section (not shown). Separating the front section of the upper portion 52A and the front section of the lower section 54A is a first central portion 56 having an upper portion end 56A and a lower portion end 56B extending from the upper portion 52 to the lower portion 54. The first central portion 56 has width which increases from the upper portion end 56A to the lower portion end 56B, wherein the upper portion end 56A is continuous with the upper portion 52 and the lower portion end 56B is continuous with the lower portion 54. Separating the back section of the upper portion and the back section of the lower portion is a second central portion (not shown) having an upper portion end (not shown) and a lower portion end (not shown) extending from the upper portion 52 to the lower portion 54. The second central portion has width which increases from the upper portion end to the lower portion end, wherein the upper portion end is continuous with the upper portion 52 and the lower portion end is continuous with the lower portion 54.

The first central portion 56 has a plurality of pockets 60 extending from the upper portion end 56A, to the lower portion end 56B. The second central portion also has a plurality of pockets (note shown) similarly configured extending from the upper portion end, to the lower portion end. The pockets 60 increase in size from the upper portion end 56A to the lower portion end 56B of the first central portion 56 and the second central portion.

A plurality of weight members (not shown) are configured in size to the pockets 60. The plurality of pockets 60 each has a bottom section 60A (illustrated in phantom) which traverse the first central portion 56 and the second central portion to distribute the weight member to an internal side of the sash 50A, wherein the weight members are centralized on a torso of a user. The pockets 60 have an access opening 64 to place and remove the weight members as desired. In this particular embodiment, the access openings 64 are equipped with a zipper. A user can readily place and remove weight members by opening and closing the zippers.

In this particular embodiment, a reflective stripe 66 is placed near the lower portion 54 of the present invention sash, which increases visibility of an user wearing the present invention sash. The placement of the reflective stripe 66 shown in FIG. 5 is for illustration purpose only, and should not be construed as an limitation. Reflective material can be placed anywhere on the exterior of the present invention sash. The embodiment shown in FIG. 5 also comprises an accessory pocket 68.

The embodiment shown in FIG. 5 further comprises a side strap 70, which releasably connects the lower edge of the front of the present invention sash 53 to the lower edge of the back of the present invention sash (not shown). The side strap 70 increases stability of the present invention sash when it is worn by a user. The length of the side strap 70 is adjustable to fit the body dimensions of a user wearing the present invention sash. The side strap 70 in FIG. 5 is shown with a buckle 71 and a hook closure 72 for illustration purpose only, and should not be construed as limitations. One skilled in the art would appreciate that any methods that would allow the adjustment of the length of the side strap or the releasably connection of the front and back of the lower edge of the present invention sash can be utilized to achieve the equivalent function. Additionally, more than one side strap may be used in alternative designs.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

The invention claimed:

1. A ergonomic exercise sash comprising:

a. an upper portion having a contour of a human shoulder having a front section continuous with a back section;

b. a lower portion having a contour of a side of a human abdomen having a front section continuous with a back section;

c. a first central portion having an upper portion end and a lower portion end extending from the upper portion to the lower portion, wherein the first central portion has width which increases from the upper portion end to the lower portion end, wherein the upper portion end is continuous with the front section of the upper portion and the lower portion end is continuous with the front section of the lower portion; and d. a second central portion having an upper portion end and a lower portion end extending from the upper portion to the lower portion, wherein the first central portion has width which increases from the upper portion end to the lower portion end, wherein the upper portion end is continuous with the back section of the upper portion and the lower portion end is continuous with the back section of the lower portion, wherein the front section and the back section of the first central portion and the second central portion have a plurality of pockets extending from the upper portion end to the lower portion end, wherein the plurality of pockets increase in size from the upper portion end to the lower portion end of the first and second central portions, and also from one side of the first and second central portions to a second side of the first and second central portions, wherein each of the pluralities of pockets have an access opening, wherein a pair of inlets are positioned about the midline of each of the access openings of the plurality of pockets.

2. The sash of claim 1, wherein the sash further includes a plurality of weight members which are configured in size to the pluralities of pockets.

3. The sash of claim 1, wherein the plurality of pockets have a bottom section which traverse the first central portion and the second central portion to distribute the weight members to an internal side of the sash, wherein the weight members are centralized on a torso of a user.

4. The sash of claim 1, wherein each of the accessing opening can be releasably closed.

5. The sash of claim 4, wherein each of the accessing opening can be open and closed with a zipper.

6. The sash of claim 1, wherein a first tension cord extends continuously through each pair of inlets on the first central portion and a second tension cord extends continuously through each pair of inlets in the second central portion.

7. The sash of claim 1, wherein the sash comprises an anti-microbial material.

8. The sash of claim 1, wherein the sash comprises reflective material.

9. The sash of claim 1, wherein the sash is symmetrical about a midline in the lower portion.

10. The sash of claim 1, wherein the sash comprises a portable media player pocket proximate to the central portion, wherein the portable media pocket comprises a portable media player securing device, cord wrap device and an eyelet configured for a spacer on a headphone set for a portable media player, wherein the portable media player pocket has a bottom section which traverse the central portion to distribute the weight of a portable media player to an internal side of the sash, centralized on a torso of a user.

11. The sash of claim 1, wherein the sash comprises a grommet centralized on the first central portion of the sash.

12. The sash of claim 1, wherein the first central portion and the second central portion has a fastener means centrally positioned.

13. The sash of claim 1, wherein the sash is a continuous one-piece.

14. The sash of claim 1, wherein the sash is one piece having a fastener to attach a first opened end on upper portion to a second opened end on the upper portion.

15. The sash of claim 1, wherein the front lower edge of the sash is releasably attached to the back lower edge of the sash.

16. The sash of claim 15, wherein the front lower edge of the sash is releasably attached to the back lower edge of the sash through one or more strap.

17. The sash of claim 16, wherein the one or more strap is adjustable in length.

* * * * *